United States Patent [19]

Morishita

[11] Patent Number: 4,971,008

[45] Date of Patent: Nov. 20, 1990

[54] PORTING ARRANGEMENT FOR MULTI-VALVE ENGINE

[75] Inventor: Isao Morishita, Iwata, Japan

[73] Assignee: Yamaha Hatsudoki Kabushiki Kaisha, Iwata, Japan

[21] Appl. No.: 357,479

[22] Filed: May 26, 1989

[30] Foreign Application Priority Data

May 30, 1988 [JP] Japan ..... 63-134058

[51] Int. Cl.[5] ..... F02B 29/00

[52] U.S. Cl. ..... 123/432; 123/52 M

[58] Field of Search ..... 123/432, 52 M

[56] References Cited

U.S. PATENT DOCUMENTS 4,528,958 7/1985 Yoshida ..... 123/432

4,549,510 10/1985 Miyakoshi et al. ..... 123/432

4,658,780 4/1987 Hosoi ..... 123/432

4,683,855 8/1987 Laimbock ..... 123/432

4,766,866 8/1988 Takii et al. ..... 123/432

*Primary Examiner*—E. Rollins Cross

*Attorney, Agent, or Firm*—Ernest A. Beutler

[57] ABSTRACT

An improved cylinder head arrangement for a multiple valve internal combustion engine wherein the cylinder head supports three intake valves that communicate with a common intake passage extending through one side of the cylinder head. An associated manifold is affixed to the cylinder head and has two inlet openings and a transition portion that forms a smooth transition from these two inlet openings to the single intake passage of the cylinder head.

3 Claims, 3 Drawing Sheets

PORTING ARRANGEMENT FOR MULTI-VALVE ENGINE

BACKGROUND OF THE INVENTION

This invention relates to a porting arrangement for a multi-valve engine and more particularly to an improved porting arrangement for such an engine which has plural inlet and plural outlet ports for the same combustion chamber of the engine.

The use of multiple valves for an internal combustion engine as a means for increasing performance for a given displacement is well known. Although the advantages of multiple valves are well known, the cost and complexity associated with multiple valve engines has limited wider use of them.

For example, when multiple valves are employed, the associated porting of the cylinder head becomes quite complicated. That is, if there are provided plural valves for an engine, it has been normally the practice to provide either plural ports, one for each valve, or a siamesed arrangement wherein all of the valves are served by the same port. Although the latter approach has the advantage of simplicity, when multiple valves are employed, there are times when it may be desirable to provide either multiple inlets or multiple outlets for the valves. For example, if the multiple valves are intake valves, it may be desirable to assure the use of plural charge formers for each chamber of the engine. When this occurs, the engine porting arrangement may have two inlets, a common passage and plural outlets. However, it is desirable to insure a smooth transition between the inlets and the outlets.

It is, therefore, a principal object of this invention to provide an improved, simplified and high efficiency arrangement for a multiple valve engine.

It is a further object of this invention to provide a multiple valve arrangement wherein the port is provided with a pair of communicating passageways that communicate with the combustion chamber through a single port but wherein flow transitions can be improved.

In connection with the specific type of arrangement previously described wherein there are multiple inlets and outlets and it is desirable to provide separation between some of the passages, the cylinder head casting can become quite complicated. That is, if two inlets must merge into a common passageway and then again diverge into plural passageways, it is very difficult to form the cylinder head casting in a simple and efficient manner.

It is, therefore, a still further object of this invention to provide an improved arrangement for providing plural passageways communicating with a common port and wherein the transition can be smooth and the plural passageways can be conveniently and simply formed.

It is a further object of this invention to provide a porting arrangement for an engine wherein a single cylinder head port is served by several passageways and the individual passageways are formed by a separate member that can be conveniently and easily attached to the cylinder head and which will provide a smooth transition.

SUMMARY OF THE INVENTION

This invention is adapted to be embodied in a porting arrangement for an internal combustion engine having a combustion chamber, three intake valves serving the combustion chamber and intake port means serving the combustion chamber and terminating at individual valve seats for each of the intake valves. The intake port means has two inlet openings that are separated by a portion that converges toward the valve seats.

In accordance with another feature of the invention, the two inlet openings and the separating portion are formed by a separate element that is affixed to the cylinder head.

DETAILED DESCRIPTION OF THE PREFERRED EMBODIMENT

Figure 1:
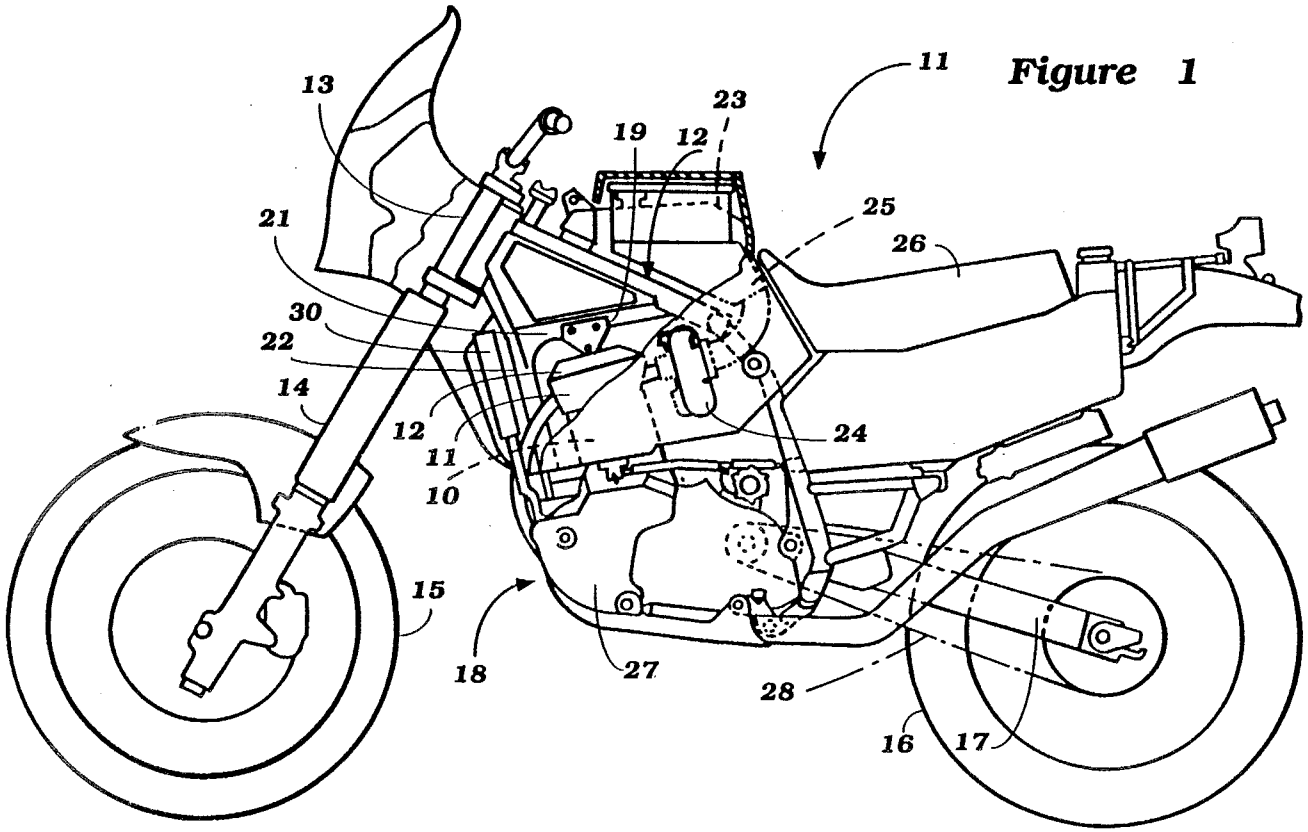
FIG. 1 is a side elevational view of a motorcycle constructed in accordance with an embodiment of the invention, with a portion broken away.

Referring first to FIG. 1, a motorcycle powered by an internal combustion engine constructed in accordance with an embodiment of the invention is identified generally by the reference numeral 11. The motorcycle 11 is depicted as a typical environment in which an engine embodying the invention may be employed. The invention has particular utility in conjunction with internal combustion engines used to power vehicles. However, it will be readily apparent to those skilled in the art that the invention may be practiced in conjunction with other engine applications.

The motorcycle 11 is comprised of a frame assembly, indicated generally by the reference numeral 12, and which is of the welded up type including a head pipe 13 that journals a front fork assembly 14 for steering movement and which supports a front wheel 15 in a known manner. In a similar manner, a rear wheel 16 is supported by the frame assembly 12 by means including a trailing arm suspension 17.

Figure 2:
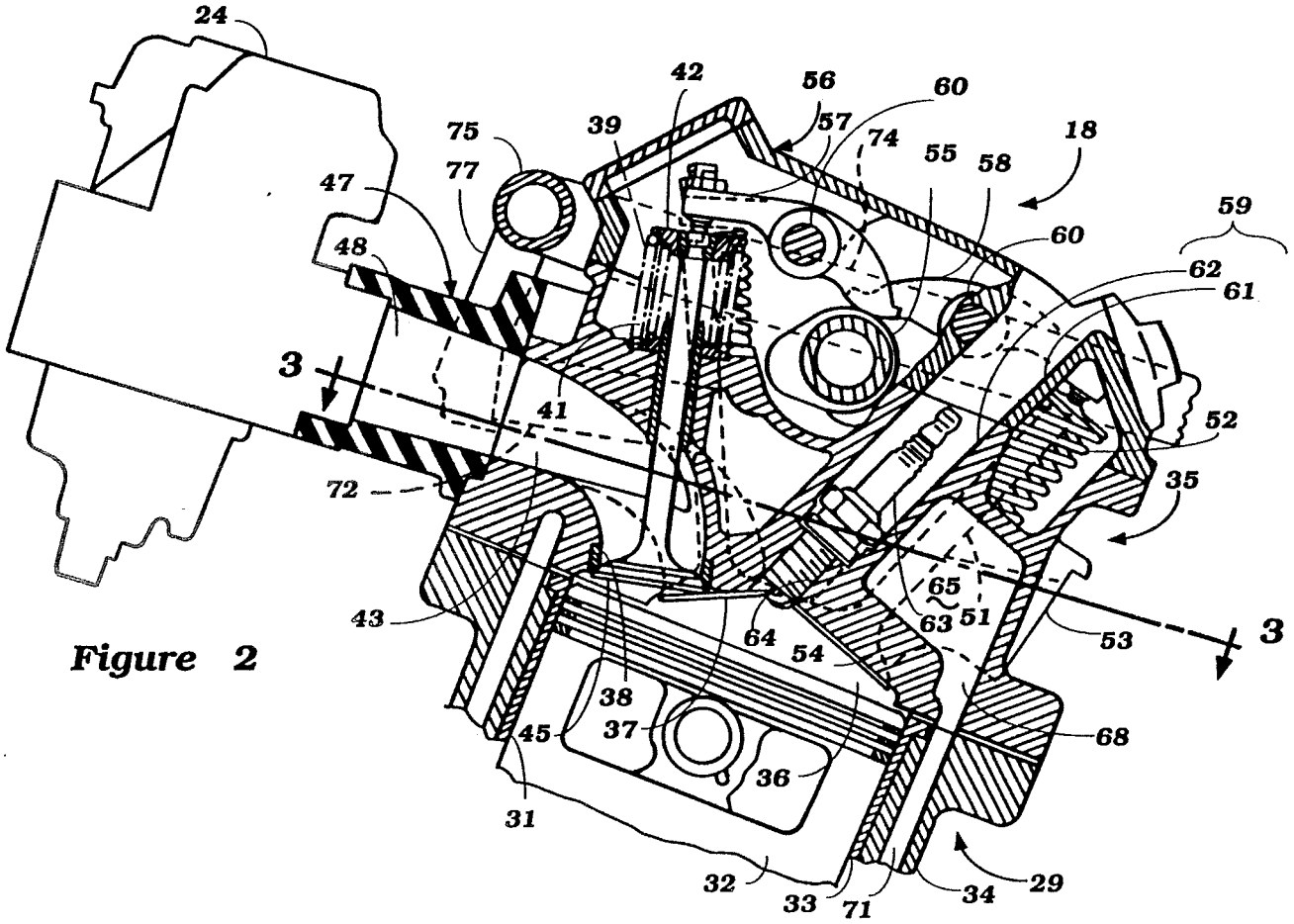
FIG. 2 is a cross-sectional view taken through a portion of the engine along a plane that passes generally through the bore of one of the combustion chambers.
Figure 3:
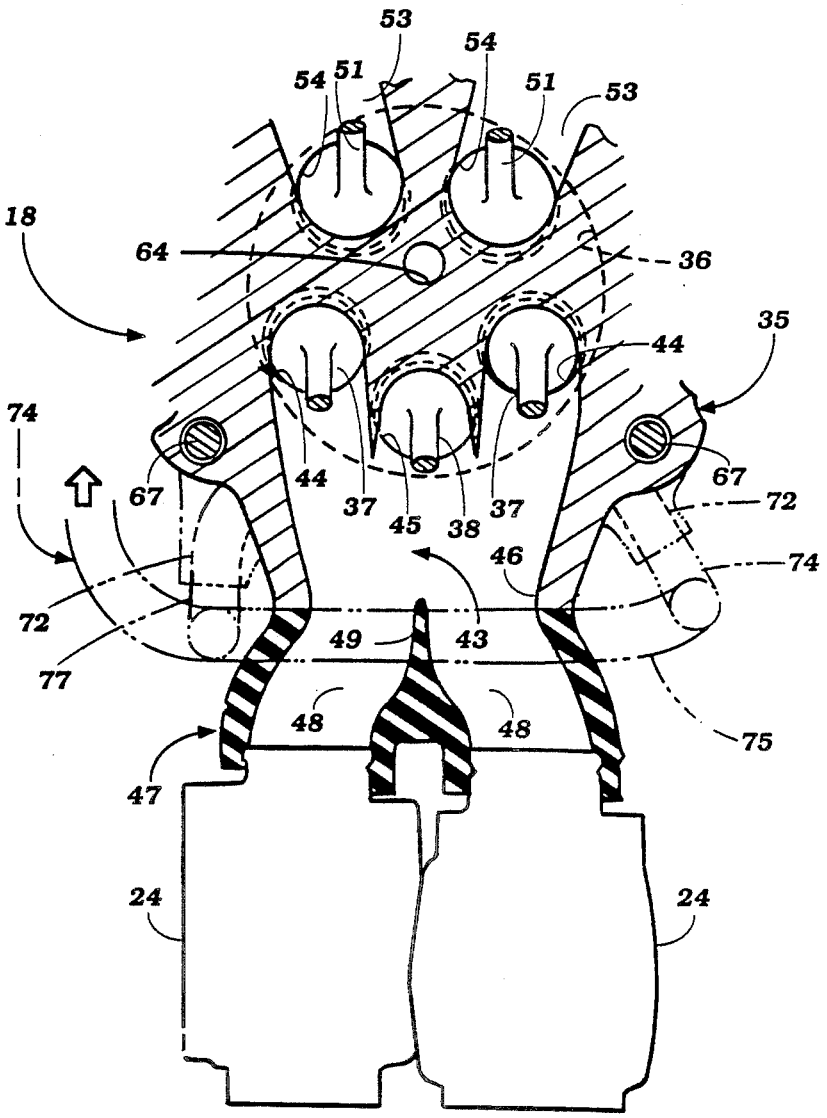
FIG. 3 is a cross-sectional view taken generally along the line 3—3 of FIG. 2.

An internal combustion engine, indicated generally by the reference numeral 18 and shown in more detail in FIGS. 2 and 3, is supported within the frame assembly 12 by means including an engine mount 19 that is affixed to a gusset plate 21 which is affixed to or forms a part of the frame assembly 12. The engine 18 is further supported in a suitable manner from a down tube 22 of the frame 12.

A fuel tank 23 is supported by the frame 12 above the engine 18 and supplies fuel to the engine in a known manner and specifically to carburetors 24 thereof. An air cleaner 25 supplies filtered air to the carburetors 24.

A seat 26 is supported on the rear of the frame assembly 12 behind the fuel tank 23 so as to accommodate a rider.

The engine 18, as is common with motorcycle practice, includes an integral crankcase, change speed transmission assembly 27 that drives the rear wheel 16 through a chain 28 in a known manner.

The engine 18 or at least portions of it are water cooled and for this purpose there is mounted a radiator 30 on the frame assembly 12 forwardly of the down tube 22. The construction of the motorcycle and its drive arrangement as thus far described ay be considered to be conventional and, for that reason, further description of the motorcycle per se is not believed to be necessary to understand the construction and operation of the invention.

Referring now, therefore, primarily to FIGS. 2 and 3, the details of the engine 18 which form the part of the invention will now be described. In the drawings, only a single cylinder and specifically the combustion chamber and valve mechanism and cylinder head arrangement therefor have been illustrated in detail since the bottom end of the engine and its construction forms no part of the invention. Also, the application of the invention to multiple cylinder engines is believed to be well within the scope of those skilled in the art.

The engine 18 includes a cylinder block 29 which may be considered to be conventional and which has a cylinder bore 31 in which a piston 32 is supported for reciprocation. The cylinder bore 31 is provided by a cylinder liner 33 that is pressed or otherwise secured into the cylinder block assembly 29 and specifically a main casting 34 thereof. The piston 32 drives a crankshaft (not shown) in a known manner.

A cylinder head, indicated generally by the reference numeral 35, is affixed to the cylinder block 29 and is formed with a lower sealing surface which surrounds a combustion chamber recess 36 and that is adapted to be affixed in sealing relationship to the upper surface of the cylinder block 29 with an interposed gasket (not shown). The piston 32 and specifically its head and the cylinder bore 31 form with the cylinder head combustion chamber recess a chamber, the volume of which cyclically varies during the reciprocation of the piston 32 as is well known.

The engine 18 is provided with an induction system that comprises a first pair of intake valves 37 which are supported for reciprocation about parallel axes within valve guides pressed into the cylinder head 35. The axes of reciprocation of the first pair of intake valves 37 is disposed at an acute angle to a plane perpendicular to the plane of FIG. 2 and containing the axis of the cylinder bore 31. There is further provided a third intake valve 38 which also is supported for reciprocation within the cylinder head 35 by means of a pressed in intake valve guides and the intake valve 38 also reciprocates about an acute angle to the aforementioned plane. However, the axis of reciprocation of the intake valve 38 is at a lesser angle than the axes of reciprocation of the intake valves 37 to this plane, as described in United States Letters Pat. No. 4,660,529, entitled "Four Cycle Engine", issued April 28, 1987, and assigned to the assignee of this application.

Each of the intake valves 37 and 38 is urged toward its closed position by means of a coil spring assemblage 39 which bears against a respective pad 41 engaged with a surface of the cylinder head 35 and a retainer 42 that is affixed by means of a keeper assembly to the upper end of the stem of the respective intake valve. The valves 37 and 38 are opened in a manner which will be described.

The intake valves 37 and 38 control the flow of a fuel/air charge, formed by the carburetors 24, through an induction passage 43 that is formed in one side of the cylinder head assembly 35 and which terminates in valve seats 44 associated with the pair of intake valves 37 and a valve seat 45 associated with the remaining intake valve 38. The valve seats 44 and 45 may be suitably pressed within the cylinder head 35 in a known manner.

The induction passage 43 forms a single opening 46 in the intake side of the cylinder head 35 and thus may be easily formed during the casting process. A manifold section 47 is affixed to this intake side. The manifold section 47 includes two intake openings 48 which are separated by a dividing portion 49 that has a generally triangular shape configuration so as to merge the two intake openings 48 gradually into a single opening at the cylinder head opening 46. This permits the use of two carburetors 24 that are affixed to the manifold 47 for delivering adequate fuel/air charge to the three intake valves 37 and 38. Of course, other forms of charge forming systems including fuel injection systems may be utilized in conjunction with the invention.

The cylinder head 35 also supports a pair of exhaust valves 51 that are disposed generally on the opposite side of the aforenoted plane and which have stem portions that are reciprocally supported within the cylinder head 35 about parallel axes. The axis of reciprocation of the exhaust valves 51 is at an acute angle to the aforenoted plane and this angle is greater than the angle of reciprocation of the single intake valve 38 and lesser than the angle of reciprocation of the pair of exhaust valves 37, as noted in aforenoted United States Letters Pat. No. 4,660,529. The exhaust valves 51 are urged to their closed position by means of coil compression springs 52 that are loaded in a manner similar to the springs 35 of the intake valves 37 and 38. These exhaust valves 51 are opened in a manner which will be described.

The exhaust valves 51 control the flow of exhaust gases through a pair of respective exhaust ports 53 that extend through the opposite side of the cylinder head from the intake port 41. The exhaust ports 53 originate at respective valve seats 54 that cooperate with each of the exhaust valves 51 in a known manner to control the flow of exhaust gases from the combustion chamber 37 into the exhaust ports 53. It should be noted that the exhaust ports 53 diverge generally from a plane that is perpendicular to the aforenoted plane and which is parallel to the plane of FIG. 2 so that the engine can clear the single down pipe 22 of the frame assembly. In this way, the engine can have adequate breathing capability and a relatively simple construction.

The intake valves 37 and 38 and exhaust valves 51 are all operated by means of a single overhead camshaft 55 that is journaled on the cylinder head assembly 35 for rotation about a camshaft axis that extends generally parallel to the aforementioned plane passing through the cylinder bore axis and perpendicular to the plane of FIG. 2. The camshaft axis is, however, offset toward the intake valves 37 and 38 and the intake valves 37 and 38 lie substantially on one side of a plane parallel to the aforenoted plane and containing the axis of rotation of the camshaft 55 while the exhaust valves 51 lie on the other side of this plane.

The manner of support for the camshaft 55 is described in my copending application entitled "Camshaft Arrangement For Multi-Valve Engine", Ser. No. 357,477, filed May 26, 1989 and assigned to the assignee of this application or my copending application entitled "Combustion Chamber And Valve Operating Mechanism For Multi-Valve Engine", Ser. No. 357,474, filed May 26, 1989, and also assigned to the assignee of this application. Since the manner of driving and supporting the camshaft 55 is not necessary to understand the construction and operation of this invention, the disclosures of those copending applications are incorporated herein by reference and will not be described again in connection with this application. It should be noted, however, that the camshaft 55 is positioned generally above an arcuately configured upper wall of the cylinder head assembly 35.

The bearing assembly for the camshaft 55 includes a cam cover and bearing cap assembly, indicated generally by the reference numeral 56 and which pivotally supports rocker arm assemblies 57 and 58 in the manner described in the aforenoted copending applications, for example, by rocker arm shafts 60, for operating the intake valves 37 and 38 and exhaust valves 51, respectively. The number of rocker arms employed for this purpose can be varied and since the rocker arm and valve operating mechanism forms no part of the invention, these features are not believed to be necessary to understand the construction and operation of the embodiment of the invention.

There is provided a spark plug well 59 consisting of aligned bores 61 and 62 formed in the cam cover 56 and cylinder head 35, respectively, to pass a spark plug 63. The cylinder head is formed with a tapped spark plug receiving opening 64 in which the spark plug 63 is received so that its gap is disposed substantially at the center of the combustion chamber 37 as may be best seen in FIG. 4. This permits good flame propagation and insures complete combustion under all running conditions.

The cylinder head 35 is provided with a very large capacity cooling jacket 65 which is configured and through which coolant is circulated as described in my copending application entitled "Cylinder Head Cooling For Multiple Valve Engine", Ser. No. 357,473, filed May 26, 1989, and assignee to the assignee of this application. The disclosure of that application is incorporated herein by reference.

It will be noted that the cylinder head 35 is affixed to the cylinder block 29 by means of a plurality of studs 67 and these studs are disposed at the corners of the combustion chamber 36 but outwardly of the area where the valves 37, 38 and 51 are supported so as to not interfere with the volume of the cooling jacket 65.

Although the disclosure of Ser. No. 357,473 is incorporated herein by reference, it should be noted that coolant is delivered to the cooling jacket 65 in proximity to the portions of the cylinder head that support the exhaust valves 51 (the more highly heated valves) by means of inlets 68 that are disposed in the recess between the portion of the cylinder head that journals the exhaust valves 51 and between the cylinder head studs 67 and the cylinder head portion that journals the outer side of the exhaust valves 51. Water is delivered to these inlets 68 from a cooling jacket 71 of the cylinder block 29.

The coolant then flows from the inlets 68 across the cooling jacket 65 toward a pair of spaced outlets 72 that are disposed outwardly of the portion of the cylinder head where the intake valve stems 37 are supported and the adjacent cylinder head studs 67. As a result, the hotter exhaust valves will be heated first and then the cooler intake valves will be cooled.

Coolant is discharged from the cooling jacket 65 and specifically the outlets 72 to a water manifold 73 that extends across the rearward portion of the cylinder head 35 from a first exit port 74 that communicates with one of the passages 72 and a cross passage 75 which then is intersected by a passage 77 exiting from the other cylinder head outlet 72 for return to the radiator 30 for cooling. Of course, this circulation is effected by a suitable pressure pump (not shown) and thermostat.

From the foregoing description, it should be readily apparent that the described construction of the cylinder head permits the use of a relatively simple casting with a single intake passageway that serves three intake valves and their valve seats. Although the cylinder head is formed with a single intake passageway, the associated manifold divides this passageway into two inlet portions so as to accommodate two separate charge formers so as to provide adequate fuel/air flow for high performance. The manifold has a smooth transition from the two inlets to the single cylinder head intake passageway so as to provide good performance.

Although the foregoing description is that of a preferred embodiment of the invention, it is to be understood that various changes and modifications can be made without departing from the spirit and scope of the invention, as defined by the appended claims.

I claim:

1. A porting arrangement for an internal combustion engine having a combustion chamber, three intake valves for serving said combustion chamber, an intake port means serving said combustion chamber and terminating at individual valve seats for each of said intake valves, said intake port means having two inlet openings separated by a portion that converges toward said valve seats.

2. A porting arrangement as set forth in claim 1 wherein the combustion chamber is formed by a cylinder head with the cylinder head having a single intake port opening through a side thereof communicating with the individual intake valve seats and wherein a manifold is affixed to said side of said cylinder head, said manifold having the two inlet openings and the portion converging toward the valve seats.

3. A portion arrangement as set forth in claim 2 further including separate charge formers communicating respectively with the inlet openings.

* * * * *